US008881746B2

(12) United States Patent
Zimmerman

(10) Patent No.: US 8,881,746 B2
(45) Date of Patent: Nov. 11, 2014

(54) REUSABLE SELF-HEATING HAIR ROLLER

(76) Inventor: Israel Harry Zimmerman, Los Angeles, CA (US)

( * ) Notice: Subject to any disclaimer, the term of this patent is extended or adjusted under 35 U.S.C. 154(b) by 161 days.

(21) Appl. No.: 13/208,606

(22) Filed: Aug. 12, 2011

(65) Prior Publication Data

US 2012/0037179 A1 Feb. 16, 2012

Related U.S. Application Data

(60) Provisional application No. 61/373,608, filed on Aug. 13, 2010.

(51) Int. Cl.
*A45D 2/36* (2006.01)

(52) U.S. Cl.
CPC ..... *A45D 2/362* (2013.01); *A45D 2/365* (2013.01); *A45D 2/367* (2013.01)
USPC ..... 132/220

(58) Field of Classification Search
USPC ..... 132/220, 222, 233, 227; 2/174; 126/263.03, 204, 263, 206
See application file for complete search history.

(56) References Cited

U.S. PATENT DOCUMENTS

| | | | | |
|---|---|---|---|---|
| 3,455,309 | A * | 7/1969 | Koss | 132/233 |
| 4,190,065 | A | 2/1980 | Kulpa | |
| 4,624,271 | A | 11/1986 | Kin | |
| 4,647,755 | A | 3/1987 | Mack | |
| 4,958,648 | A | 9/1990 | Morey | |
| 5,056,589 | A * | 10/1991 | Hettel et al. | 165/10 |
| 5,275,156 | A * | 1/1994 | Milligan et al. | 607/114 |
| 5,606,983 | A | 3/1997 | Monty et al. | |
| 6,918,138 | B2 * | 7/2005 | Donovan | 2/174 |
| 7,942,145 | B2 * | 5/2011 | Palena et al. | 126/263.03 |
| 2009/0151046 | A1 * | 6/2009 | Donovan | 2/174 |

OTHER PUBLICATIONS

PCT International Searching Authority, "Notification Of Transmittal Of The International Search Report And The Written Opinion Of The International Searching Authority, Or The Declaration", PCT Patent Application No. PCT/US2011/047602, Apr. 27, 2012, 9 pages.

* cited by examiner

*Primary Examiner* — Robyn Doan
(74) *Attorney, Agent, or Firm* — Walter W. Duft

(57) ABSTRACT

A reusable self-heating hair roller includes a fluid holding body containing a supercoolable fluid. The fluid holding body may be implemented in many ways, including as non-permeable, incorruptible, air-tight film, bladder or casing. The supercoolable fluid, such as sodium acetate or equivalent, uses thermochemistry to produce on command an exothermic crystallization process that generates the heat needed to style and or curl the hair. A nucleation initiator initiates a nucleation event that propagates the crystallization to harnesses the latent heat of fusion and create the heat. The nucleation initiator may be situated so that it is generally sequestered or otherwise held in a way where it is prevented from free floating within the supercoolable fluid, yet at the same time remains in full communication with the fluid.

39 Claims, 12 Drawing Sheets

REUSABLE SELF-HEATING HAIR ROLLER

CROSS-REFERENCE TO RELATED APPLICATIONS

This application claims priority to and the benefit under 35 U.S.C. 119(e) of U.S. Provisional Application No. 61/373,608, filed on Aug. 13, 2010. The entire contents of said Provisional Application No. 61/373,608 are hereby incorporated by this reference as if fully set forth herein.

BACKGROUND

1. Field

The present disclosure relates to hair rollers for styling hair. More particularly, the disclosure concerns the heating of hair rollers to facilitate their hair setting function.

2. Description of the Prior Art

By way of background, hair styling has been a vanity issue for centuries, if not millenia. The hair styling marketplace is littered with alternative systems for curling and otherwise styling hair using hair rollers. Almost all hair roller systems rely on some type of standalone base heating unit that acts as a heat distribution center to impart heat to each individual roller (also known as a curler), which is designed to absorb the heat. After the roller is fully heated, it is removed from the heat source and placed in the hair so that the stored heat energy is then dissipated or transferred onto the hair being styled. A disadvantage of this type of hair roller system is that the user must wait for the base heating unit to warm up and for the rollers to be heated to the required temperature. Mobility is also limited insofar as the base heating unit is a necessary requirement of use. The base unit is usually bulky and requires an energy source (usually an electrical outlet) in order for it to operate.

In addition, from a quality control perspective, there really is no way for the user to know with any sense of certainty when the optimum curling temperature has actually been realized by the roller. Also, environmental interference and mechanical wear and tear must be accounted for. In many cases, consistent temperatures are not really an achievable goal over an extended period of use. Thus, results may not be consistent.

Finally, because the roller is dependent on the base heating unit for imparting heat energy, the maximum peak energy transmitted onto the roller begins to decline from the moment it is removed from the heat source. As such, there is a inverse relationship between how long it takes the user to place the hot roller in the hair and the ultimate heat energy that will remain with the roller and be available for hair styling. The longer it takes, the less energy remaining, resulting in inconsistent results. To mitigate this problem, some hair roller systems are designed so that the rollers are superheated to account for the inevitable heat loss that occurs prior to rolling the hair around the roller. This can result in burns to the user.

Previously, there have been a few attempts to harness the benefits of exothermic energy for hair rollers, however each of these designs has inherent limitations. Most notably is Morey U.S. Pat. No. 4,958,648 and Kulpa U.S. Pat. No. 4,190,065. Both use exothermic materials as a means of creating an exothermic environment within a hair roller. However, in both cases the exothermic reaction is initiated by introducing a new and separate substance into an existing compound in order to create the thermal reaction.

In Morey, a syringe ruptures the casing of the material container in order to introduce and create a new chemical mixture that generates reaction heat. The Morey device is not reusable and requires the cumbersome injection of a reaction triggering material.

In Kulpa, the exothermic reaction is dependent on a moisture absorbent material that extracts moisture from the wet or moist hair of the user and then mixes with the chemical contained in the roller, which combines through a permeable membrane in the apparatus. The more moist the hair, the more steam and or heat. Dry hair means no heat, and the device will not work. The device requires outside intervention every time it is used.

In each of the foregoing devices, the chemical reaction is not self contained and requires the introduction of a foreign element. These features impose limitations on portability, re-usability and conditions of how and where such devices can be used.

SUMMARY

According to example embodiments, a reusable self-heating hair roller includes a fluid holding body containing a supercoolable fluid. The fluid holding body may be implemented in many ways, including as a non-permeable, incorruptible, air-tight film, bladder or casing. For example, the fluid holding body could be a suitable non-permeable enclosure structure that can be rigid, semi-rigid or fully flexible. If the fluid holding body is flexible, it may be designed for use in combination with a rigid or semi-rigid support structure that can provide the required rigidity and shaping to create the desired structure needed to curl or otherwise style the hair as desired. The supercoolable fluid, such as sodium acetate or equivalent, uses thermochemistry to produce on command an exothermic crystallization process that generates the heat needed to style and or curl the hair. A nucleation initiator initiates a nucleation event that propagates the crystallization to harnesses the latent heat of fusion and create the heat. The nucleation initiator may be situated so that it is generally sequestered or otherwise held in a way that prevents it from free floating within the supercoolable fluid, yet at the same time remains in full communication with the fluid. An optional triggering device may be used to activate the nucleation initiator. Once the latent heat energy is used up and the supercoolable fluid is totally crystallized, the fluid may be recharged by exposing it to a suitable temperature, such as approximately 100° C., for a predetermined length of time. The disclosed self-heating hair roller can be rolled into the hair in the usual manner. Unlike conventional hair rollers, the disclosed hair roller can be activated either prior to or after the device is placed in the hair.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Introduction

Figure 1:
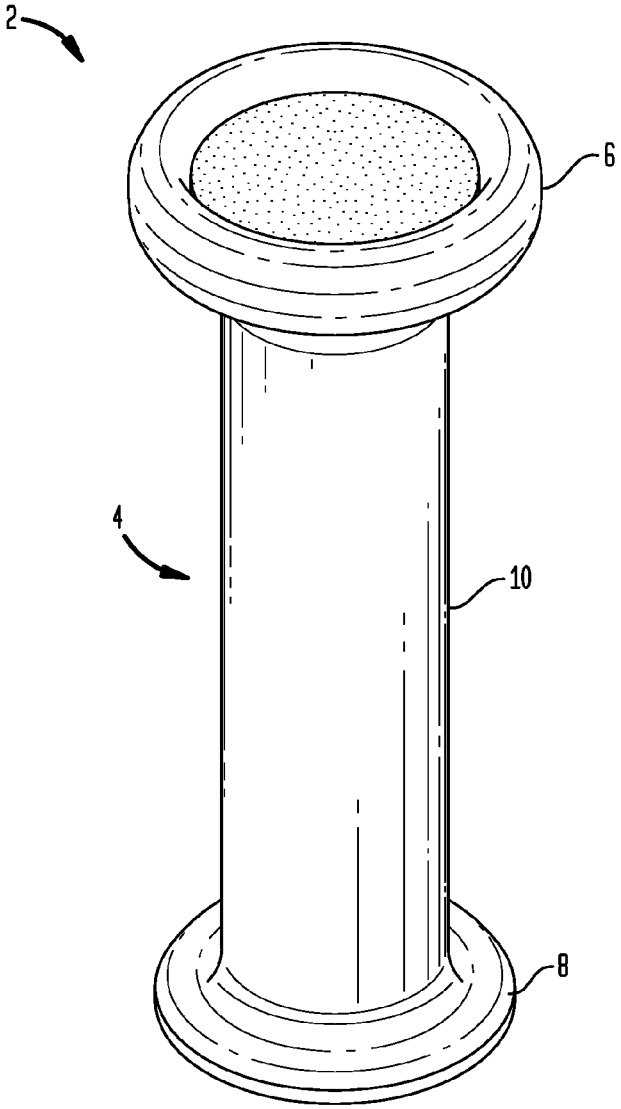
FIG. 1 is a perspective view showing self-heating hair roller that may be constructed in accordance with the design principles set forth herein.

A reusable self-heating hair roller will now be described by way of several example embodiments that are disclosed herein by way of example only and not by way of limitation. The disclosed hair rollers each include a non-permeable, air tight, fluid holding body, such as a film, bladder or casing, containing a supercoolable fluid. The fluid holding body that contains the supercoolable fluid may be formed of any suitable enclosed non-permeable structure that can be rigid, semi-rigid or fully flexible. As used herein, a rigid fluid holding body will be substantially stiff and non-deformable during normal usage. A semi-rigid fluid holding body may slightly deform during normal usage (depending on the hand pressure exerted by the user), but will quickly return to its initial configuration in the event that it is deformed. A flexible fluid holding body will easily deform when it is lifted and manipulated by a user. If the fluid holding body is flexible, it will typically be used in combination with a supporting rigid or semi-rigid structure that can provide the required rigidity and shape needed to curl or otherwise style the hair as desired. The supercoolable fluid may comprise a material selected from the group consisting of sodium acetate (also known as sodium acetate trihydrate) and other fluids that can be supercooled below their melting point to room temperatures levels. The chemical formula for sodium acetate is $C_2H_3NaO_2$. Its melting point is 58° C. If desired, the supercoolable fluid may also include a diluting agent such as water, vinegar, etc. Thus, for example, if the supercoolable fluid comprises sodium acetate, the sodium acetate may be present in pure form or in a solution at a desired concentration.

As is known, sodium acetate is commonly used in hand warmers. If this material is heated to approximately 100° C. and then allowed to cool without having an opportunity to recrystallize, it can remain liquid even at room temperatures and below. The sodium acetate becomes supersaturated and will remain in liquid form unless it is triggered by a nucleation event to recrystallize. The crystallization process for sodium acetate is exothermic, generating 264 to 289 joules of energy for every gram of fluid.

The hair rollers disclosed herein are designed so that, upon command, the exothermic crystallization process can be initiated in the supercoolable fluid, causing it to solidify while generating the heat needed to style and/or curl the hair. A nucleation initiator is provided to initiate the required nucleation event. Optionally, the nucleation initiator may be sequestered in a manner that prevents it from free floating within the supercoolable fluid. At the same time, the nucleation initiator can remain at all times in communication with the supercoolable fluid. In some embodiments, a supplemental triggering device may be used to activate the nucleation initiator from outside the fluid holding body.

Sequestration refers to the fact that the nucleation initiator (in embodiments that utilize this option) does not have the unfettered ability to free-float around the fluid holding body. In some embodiments, the nucleation initiator will be completely fixed in space so that it cannot move within the fluid holding body. In other embodiments, the nucleation initiator will be limited to a narrow range of free movement so that it remains in the same approximate location within the fluid holding body. In this way, the nucleation initiator will only be accessible for activation at a designated wall or other surface portion of the fluid holding body (such as an end wall, a side wall, etc.) and will not move out of range of such designated activation location. The nucleation initiator will remain predictably accessible as measured by the user's ability to locate and activate the nucleation initiator at the activation location. The user will be able to access the nucleation initiator without reliance on any visual cue or dependence on any specific up or down orientation of the roller itself, and notwithstanding normal gravitational forces that would otherwise pull the nucleation initiator away from the designated activation location as the roller orientation changes. Sequestration is particularly advantageous when the roller's fluid holding body is rigid or semi-rigid, and a supplemental trigger is provided at the designated activation location to activate the nucleation initiator. Indeed, such a construction may not be practical without sequestration. In other constructions that do not have a supplemental trigger, the designated activation location of the fluid holding body may be deformable so that the user can activate the nucleation initiator by squeezing, depressing or otherwise causing deformation of the body at the designated location.

Sequestration may also mean that the nucleation initiator is maintained in a stable orientation in space, such as where orientation is a factor in the nucleation initiator's operation and it is desired to restrict its ability to rotate relative to one or more axes. In some embodiments, the nucleation initiator may be retained in a completely fixed orientation. In other embodiments, the nucleation initiator may be restricted to some range of orientations. In other embodiments the nucleation initiator may be fixed or limited with respect to one or two axes of rotation but not restricted with respect to a third axis of rotation, and so on.

As an example of sequestration, assume that the fluid holding body is made out of an opaque rigid material and the nucleation initiator is sequestered at one end of the roller (the sequestered end) that mounts a supplemental trigger. Assume further that the user places three such rollers in the hair so that they are out of the user's visual range. For example, the user might place one roller with the sequestered end facing up, the second roller with the sequestered end facing at a right angle, and the third roller with the sequestered end facing down. In all three orientations, the user would be able to initiate the exothermic reaction by knowing that the nucleation initiator is always at the sequestered end of each roller (representing the designated activation location), which, due to the supplemental trigger, will have a distinctive tactile characteristic that is different from the non-sequestered end of the roller. The sequestered end of the roller will always remain in the same relative location on each roller, allowing it to be identified even though its absolute location varies depending on how the roller is placed. As stated, the sequestered end (representing the designated activation location) would be at the top of the first roller, on the side of the second roller, and on the bottom of the third roller. Notwithstanding these different roller positions, the sequestered end will be readily locatable and the nucleation initiator will be accessible as a result of sequestration, allowing the user to to activate the roller regardless or orientation, visual acuity or rigidity of the casing surrounding the supercoolable fluid and the nucleation device.

Sequestering of the nucleation initiator may be accomplished in a number of different ways. For example, the nucleation initiator could be enclosed within a separate bladder, film, casing or other enclosure that is within the fluid holding body. Alternatively, the fluid holding body could have a inner wall or other structure restricting the movement of the nucleation initiator. In each of the foregoing examples, the nucleation initiator will be limited in its ability to float freely within the supercoolable fluid. Additional sequestration examples will be seen in the specific embodiments described in more detail below and shown in the accompanying drawings.

The disclosed hair rollers can be rolled into the hair in the usual manner. Unlike conventional hair rollers, the disclosed hair rollers can be activated either prior to or after they are placed in the hair. Once the latent energy of the supercoolable fluid is used up and the fluid is fully crystallized, the disclosed hair rollers can be recharged (for reuse) by exposure to a suitable temperature, (e.g., 100° C. for sodium acetate) for a brief period of time, followed by removal from the heat to allow the fluid to again become supercooled.

The disclosed hair rollers are meant to be placed in the hair and left in place for an optimum period of time to effectuate the desired wave, rolled or body enhancement. Advantageously, the hair rollers are not dependent on the introduction of any ancillary additional compound or moisture to influence the exothermic reaction in order to generate the desired heat. When the disclosed hair rollers are used, the nucleation initiator can be activated either before or after the hair is rolled. In addition, once the hair rollers are charged or recharged, the supercoolable fluid therein will remain in a supercooled ready state and can be triggered into an exothermic state whenever desired. The hair rollers do not rely on any base heating unit or other external heat source. The hair rollers are thus truly portable devices that can be used anyplace anytime.

Unlike the traditional externally heated rollers that immediately begin cooling when they are removed from the base heating unit, the hair rollers disclosed herein will maintain a steady temperature for an extended period of time. By using internal thermochemistry rather than an external heat source, the curling process becomes more stable and predictable. For example, by using the known heat-generating properties of sodium acetate, and by accounting for the fluid volume and heat conducting properties of the remaining hair roller materials, one can reliably predict roller surface temperature and heat duration. Unlike a mechanical system or an electrical conductivity system that transfers heat and is susceptible to wear and tear and environmental interference, the disclosed hair rollers provide a system that will generally create the same level and duration of heat each and every time they are used.

As previously stated, the user has the ability to roll or otherwise place the disclosed hair rollers into the hair while they remain at ambient temperature. The rollers may then be activated once they are in place. Alternatively, the disclosed rollers may be activated first and then rolled into the hair. This is possible because maximum temperature is not attained until sometime after crystallization is initiated.

The fluid holding body may be designed in many different ways. As stated, it is preferably impermeable and air-tight so that the supercoolable fluid remains pristine and isolated from outside contaminants, and so that it will not leak. According to embodiments disclosed herein, the fluid holding body could be formed from a flexible structure, a rigid structure or a semi-rigid structure. The use of flexible structures is advantageous because the supercoolable fluid becomes rigid as it crystallizes. This allows the user of a flexible or non-rigid embodiment to bend the hair roller into a desired shape for styling and have it hold in the new shape once the nucleation initiator is activated and the supercoolable fluid is crystallized.

If the container is flexible, it may be used in combination with a semi-rigid or rigid support structure that can provide the required rigidity and shaping to create the desired structure needed to curl or otherwise style the hair as desired. The support structure may be external to the fluid holding body or disposed internally therein.

The illustrated embodiments contemplate a generally oval, round or cylindrical-shaped fluid holding body similar to what is found in a traditional hair roller. However, it should be understood that alternative shapes could be used as well, such as a shape that instead of curling hair has an optimized shape so as to straighten or add body or wave to the hair.

The nucleation initiator may be provided by any object that is capable of triggering crystallization of the supercoolable fluid within the fluid holding body. For example, as in a hand warmer, a small metal clicker may be used. As stated, a supplemental triggering device may be used to activate the nucleation initiator. This can be advantageous if the fluid holding body is rigid or semi-rigid, or if it is contained within a support structure.

As also mentioned above, some embodiments disclosed herein strategically position the nucleation initiator at a desired location within the fluid holding body so that the user will have a predictable point of contact for the activation of the supercoolable fluid. For example, by strategically sequestering or limiting the location of the nucleation initiator to either end of the hair roller, the roller can be activated even when the hair roller has been placed in the hair and the majority of the roller is submerged under the volume of hair wrapped around the device. The user will thus be able to effectuate a unique order of operation whereby the user could first roll the hair onto the non-heated hair roller. Only after the hair and the hair roller are both in the desired position would the user activate the nucleation initiator and begin the process of heat generation.

This feature is desirable and particularly relevant today where science has afforded the beauty industry various newly-developed heat-activated conditioners and vitamins. As this new category of hair products remain dependent on heat as a catalyst for conditioning and the like, there is a clear advantage in allowing the user the ability to first position the hair into it's desired position prior to exposing it to a heated environment where the conditioner of a hair care product might otherwise be activated prematurely. The actual strategic location for the nucleation initiator would be dependent on the objective of the styling use.

An example method for recharging the disclosed hair rollers would be to place them in an environment of boiling water and/or steam or other kinds of heat. One such apparatus is disclosed herein for purposes of example only. Other methods are also contemplated so long as the fluid is the fluid holding body is heated above the appropriate liquefaction temperature.

Example Embodiments

Figure 2:
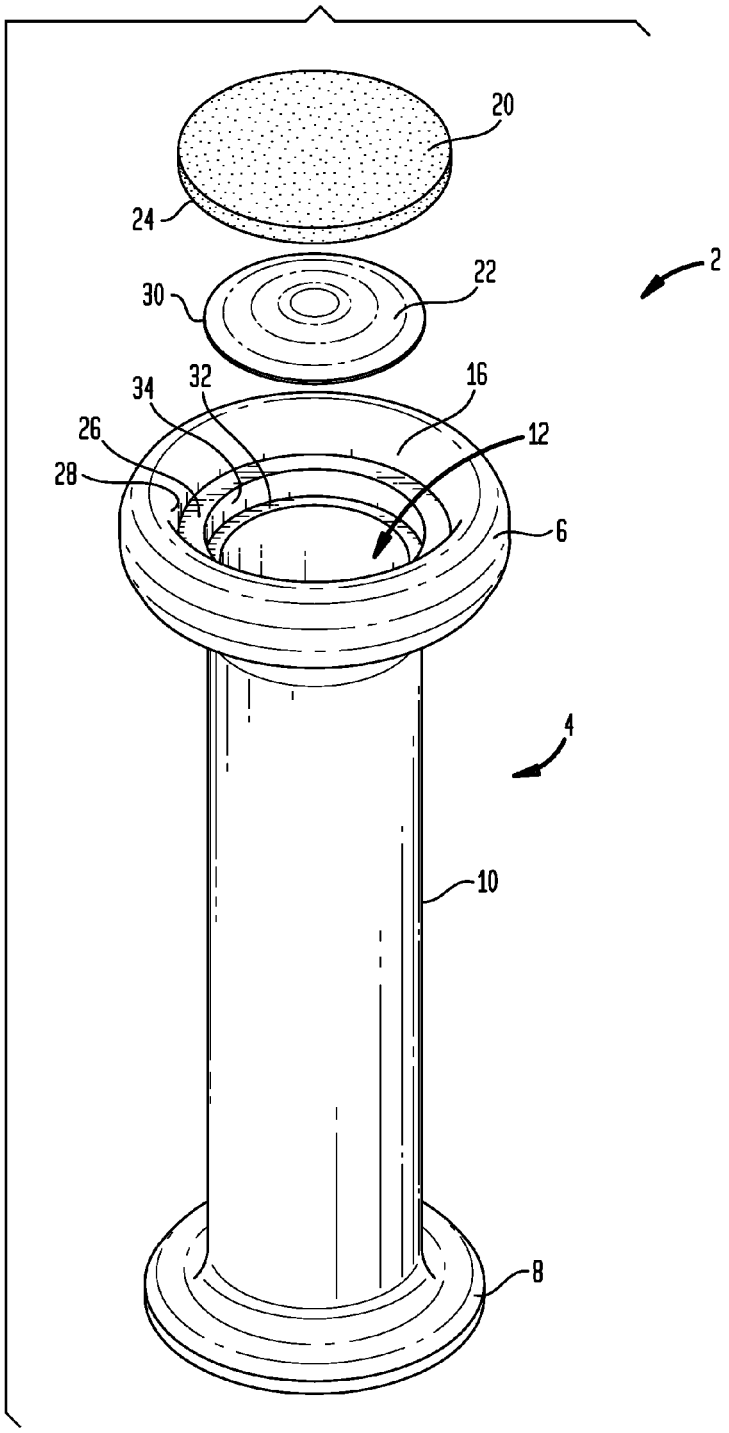
FIG. 2 is exploded view showing the hair roller of FIG. 1.
Figure 3:
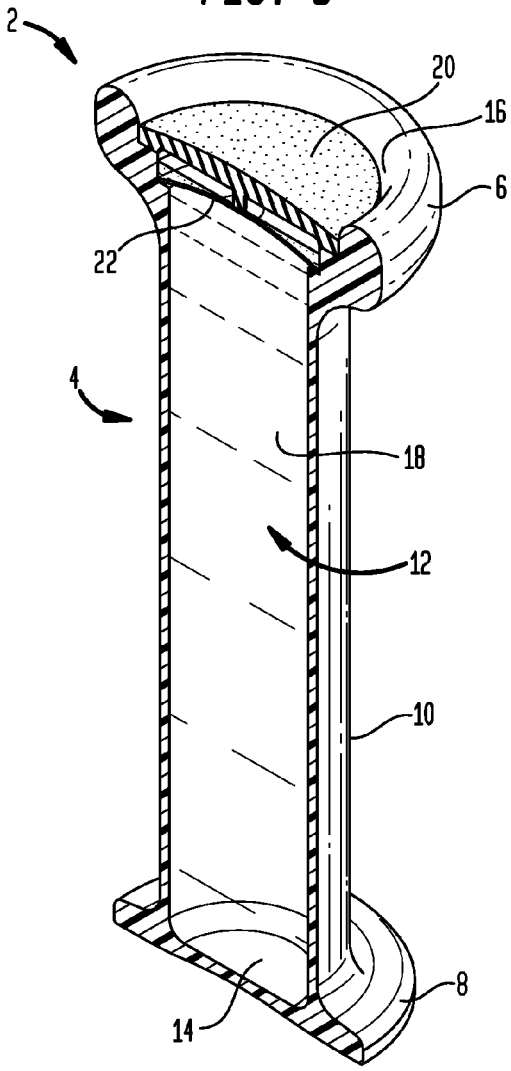
FIG. 3 is a cross-sectional longitudinal centerline view showing the hair roller of FIG. 1.
Figure 4:
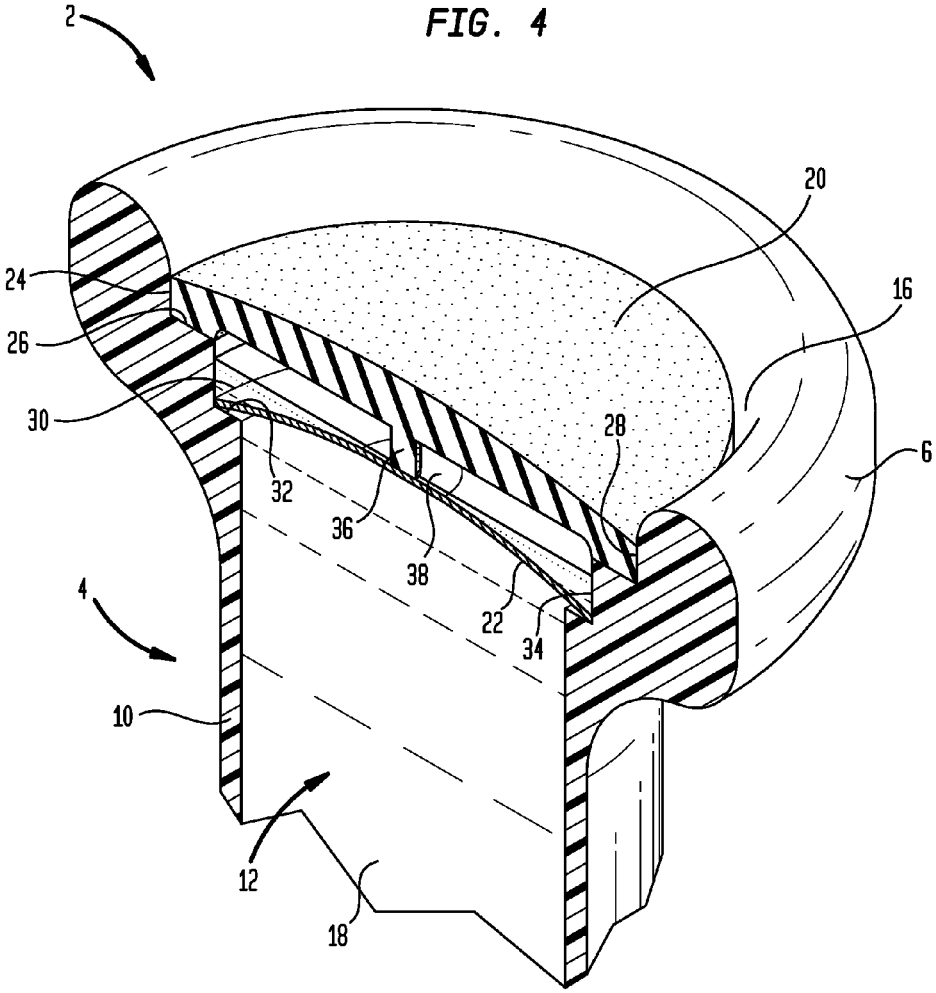
FIG. 4 is an enlarged fragmentary cross-sectional view showing one end of the hair roller of FIG. 1.

Turning now to FIGS. 1-4, an example embodiment 2 of a reusable self-heating hair roller is shown. The hair roller 2 comprises an elongated fluid holding body 4 that is constructed as a rigid or semi-rigid casing that comprises a pair of upper and lower end members, 6 and 8 respectively, and a wall portion 10 extending between the end members. The end members 6/8 may be generally circular in shape and the wall portion 10 may have a generally cylindrical configuration (or any other desired shape). The fluid holding body, including the end members 6/8 and the wall portion 10, may be formed from any suitable material(s), such as rigid or semi-rigid plastic, rubber, etc. Any suitable fabrication technique may be used to manufacture the fluid holding body 4 including but not limited to injection molding, machining, etc. As shown in FIG. 3, the entire fluid holding body 4 may be of unitary construction. Alternatively, the fluid holding body 4 could be formed from an assembly of several parts (e.g., by separately mounting the end members 6/8 to the wall portion 10). As can be seen in FIG. 2, the wall portion 10 defines a hollow main cavity 12 in the fluid holding body 4. The bottom of the main cavity 12 is closed by the lower end member 8, which has a solid configuration that includes an interior wall 14. The top of the main cavity 12 has a hollow interior 16 that provides an upper opening for accessing the main cavity 12. As shown in FIGS. 3 and 4, the main cavity 12 provides a fluid chamber in the fluid holding body 4 that is wholly or partially filled with a supercoolable fluid 18, such as sodium acetate.

As can be seen in FIGS. 2-4, a trigger 20 may be mounted on the upper end member 6 so as to cover some or all of the hollow interior 16. A dome-shaped clicker 22 acting as a nucleation initiator may be sequestered at a fixed or limited range of predetermined locations in relative proximity to the trigger 20. The trigger 20 may be formed as a resilient button-shaped member made from flexible plastic, rubber or other suitable material. In the embodiment of FIGS. 1-4, the trigger 20 has a circular perimeter 24 that seats on a first annular ledge 26 formed within the upper end member's hollow interior 16, and in peripheral engagement with a first interior side wall 28 of the upper end member 6. Based on this configuration, the end member 6 may be referred to as the trigger end of the hair roller 2 and the end member 8 may be referred to as the base end of the hair roller 2.

The clicker 22 may be formed as a generally dome shaped member made of metal or plastic. The clicker 22 is located so that it is in fluid communication with the supercoolable fluid 18, and is arranged so it can be activated by the trigger 20 at the trigger end 6 of the fluid holding body 4, which represents a designated activation location on the roller 2. In the embodiment of FIGS. 1-4, the clicker 22 has a circular perimeter 30 that seats on a second annular ledge 32 that is formed below and stepped radially inwardly from the first annular ledge 26 within the upper end member's hollow interior 16. The clicker's perimeter 30 peripherally engages a second interior sidewall 34 of the upper end member 6.

It will be seen in FIG. 4 that the trigger 20 is sized to fit tightly against the first interior side wall 28 of the upper end member 6 when the trigger is supported on the first annular ledge 26. The trigger 20 may be retained in this position by way of an interference fit between its perimeter 24 and the first interior side wall 28. Alternatively (or in addition), an adhesive or mechanical fastening arrangement could be used. In any case, the trigger 20 may be designed to act as a seal that seals the upper end of the main cavity in order to retain the supercoolable fluid 18. If desired, the trigger 20 may be formed with a central post 36 that extends downwardly to contact a central portion 38 of the clicker 22. This arrangement allows the clicker 22 to be spaced downwardly from the trigger 20 into the main cavity 12. In other words, the spacing between the first annular ledge 26 and the second annular ledge 32 may be increased. Insofar as the first annular ledge 26 represents the topmost fill level of the supercoolable fluid 18, the ability to locate the second annular ledge 32 further downwardly therefrom allows at least the lower surface of the clicker 22 to be in complete interfacial contact with the supercoolable fluid. The upper surface of the clicker 22 may also be in full or partial interfacial contact with the supercoolable fluid 18, depending on the clicker's actual downward displacement relative to the first annular ledge 26. This ensures that the clicker 22 will always be in a position to initiate nucleation of the supercoolable fluid 18, regardless of roller orientation.

During operation of the hair roller 2, a user will push on the trigger 20 in order to displace it toward the main cavity 12 of the fluid holding body 4. The trigger's central post 36 will in turn push downwardly on the clicker's central portion 38 to deform the clicker 22 until it briefly clicks or snaps into an over-center condition. This initiates a nucleation event that starts an exothermic crystallization reaction within the supercoolable fluid 18. When the trigger 20 is released, the clicker 22 will resiliently rebound to its starting (non-over-center) position. The clicker 22 is prevented from becoming stuck in the over-center position due to the fact that the central portion 38 thereof is generally flat as compared to the remainder of the clicker 22, which is dome shaped. In addition, the clicker's perimeter 30 is captured by the second interior sidewall 34 of the upper end member 6 to prevent the perimeter from expanding radially outwardly as the clicker 22 is flattened. Without such control over the clicker 22, it could be pushed to a permanent over-center position (so that it becomes permanently concave toward the trigger 20), and may not be capable of further activation so that the hair roller 2 cannot be reused.

In the embodiment of FIGS. 1-4, the clicker 22 is not intended to seal the supercoolable fluid 18 within the main cavity 12. That function is performed by the trigger 20. However, a modification of the hair roller 2 could be implemented in which the clicker 22 does act as a seal. In that case, the trigger 20 would be optional and would merely serve as an external and supplemental trigger device. In a further modification of the hair roller 2, the clicker 22 could be mounted to the underside of the trigger 20 instead of being spaced therefrom.

Figure 5:
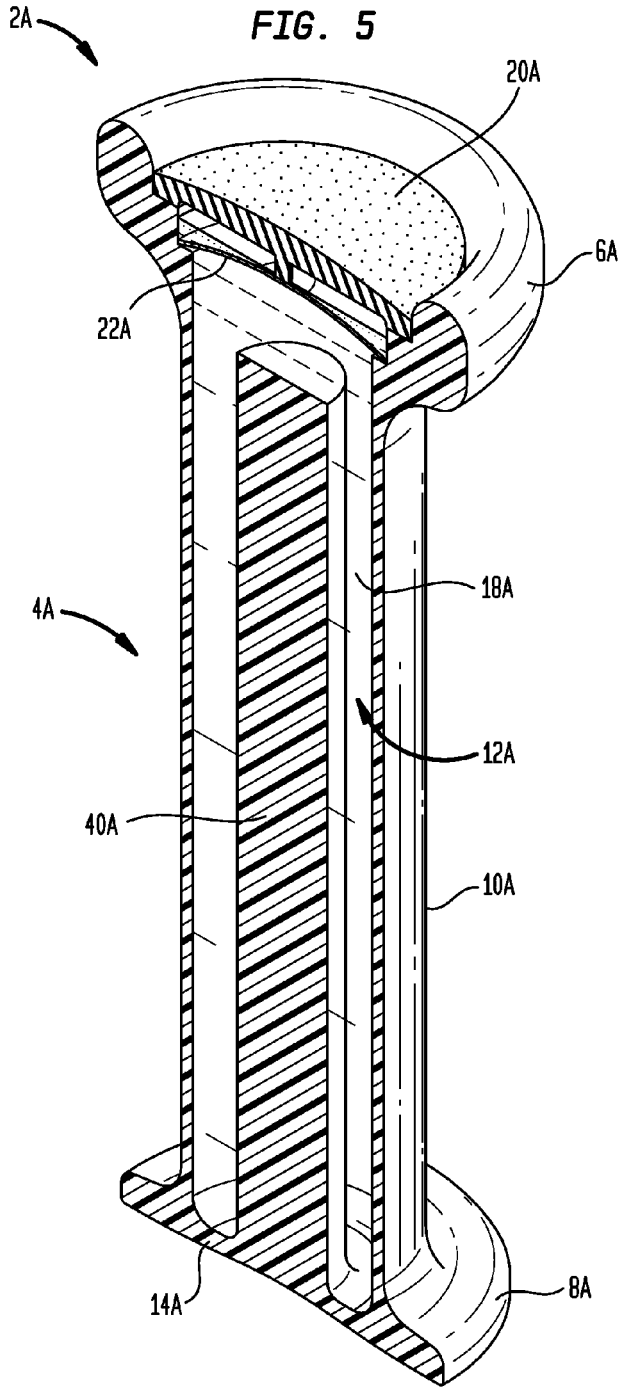
FIG. 5 is a perspective view showing a modification of the hair roller of FIG. 1.

Turning now to FIG. 5, a modified version 2A of the reusable self-heating hair roller 2 of FIGS. 1-4 is shown. Components of the hair roller 2A that correspond to components of the hair roller 2 are shown by the use of corresponding reference numbers appended with the letter "A." The hair roller 2A is similar to the hair roller 2 except that it is provided with a central interior post 40A of selected diameter and height within the main cavity 12A. The interior post 40A (which can be solid or hollow) extends upwardly from the interior wall 14A of the lower end member 8A. It serves as a volume controller that may be used to control the amount of the supercoolable fluid 18A within the main cavity 12A. This, in turn, controls the heat output of the hair roller 2A. It will be appreciated that other volume control members of various shape and size could also be used in lieu of the interior post 40A. As in the case of the interior post 40A, such alternate forms of volume controller could be attached to a portion of the fluid holding body 4. Alternatively, a non-attached volume controller that is free to move about within the main cavity 12A could be used. According to a further modification. The size of the main cavity 12A itself could be varied, such as by changing the thickness of the wall portion 10 or by changing other dimensions of the fluid holding body 4. However, the advantage of using a volume controller such as the interior post 40A is that the outside dimensions of the hair roller 2A may be changed without changing the heat output. A large diameter hair roller could thus be designed to produce the same heat output as a small diameter hair roller by adding a volume controller of suitable size so that the volume of supercoolable fluid within each roller is the same.

Figure 6:
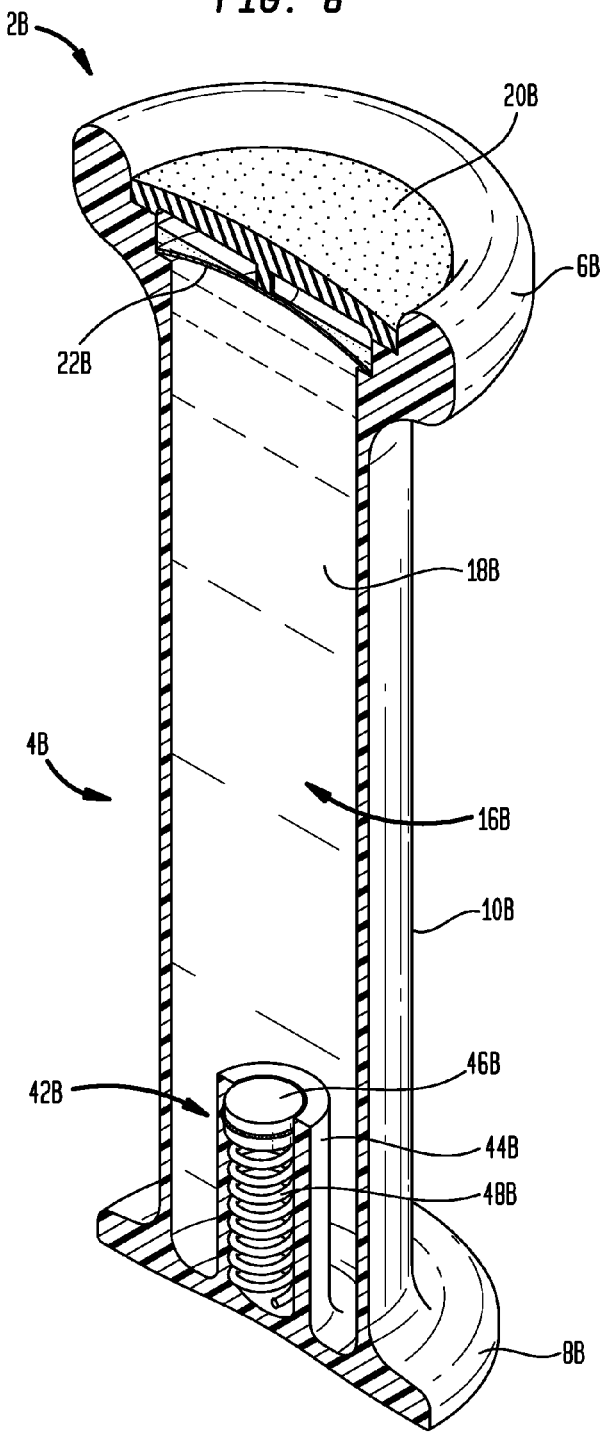
FIG. 6 is a perspective view showing another modification of the hair roller of FIG. 1.

Turning now to FIG. 6, another modified version 2B of the reusable self-heating hair roller 2 of FIGS. 1-4 is shown. Components of the hair roller 2B that correspond to components of the hair roller 2 are shown by the use of corresponding reference numbers appended with the letter "B." The hair roller 2B is similar to the hair roller 2 except that it is provided with a volume compensation component 42B within the main cavity 12B. This component includes a tubular cylinder 44B that extends upwardly from the flat interior wall 14B of the lower end member 8B. A spring-loaded plunger 46B is slidably disposed within the cylinder 44B. It is biased upwardly by a coil spring 48B. An seal on the periphery of the plunger 46B prevents the supercoolable fluid 18B from entering the lower part of the cylinder 44B (where the spring 48B is located). The volume compensation component 42B compensates for a decrease in the fluid-holding volume of the main cavity 16B that could otherwise be caused by activation of the trigger 20B as it pushes the clicker 22B into the supercooled fluid 18B. Pressing downwardly on the trigger 20B would cause the supercoolable fluid 18B to depress the plunger 46B, thereby compensating for the loss of fluid volume caused by the downward trigger displacement.

Figure 7:
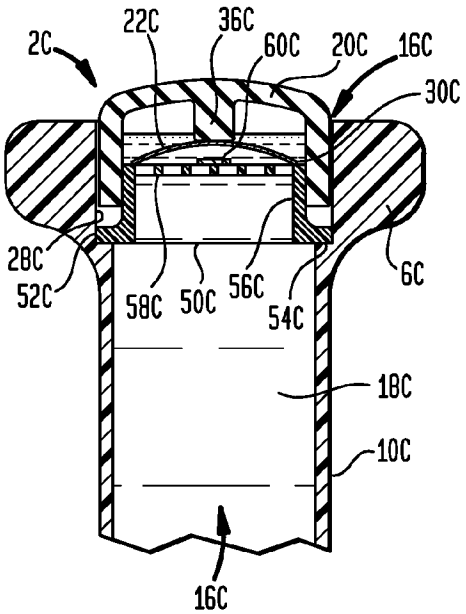
FIG. 7 is a partial cross-sectional centerline view showing another modification of the hair roller of FIG. 1.

Turning now to FIG. 7, another modified version 2C of the reusable self-heating hair roller 2 of FIGS. 1-4 is shown. Components of the hair roller 2C that correspond to components of the hair roller 2 are shown by the use of corresponding reference numbers appended with the letter "C." The hair roller 2C is similar to the hair roller 2 except that the trigger 20C is implemented as a rigid push button that is slidably mounted in the hollow interior 16C of the upper end member 6C. The trigger 20C it is provided with a downwardly extending post 36C that engages a clicker 22C. The clicker 22C is in communication with the supercoolable fluid 18C within the main cavity 16C. The clicker 22C is mounted on a clicker retainer embodied as a clicker support structure 50C on which the clicker is supported and maintained in close proximity to the overlying trigger 20C. The support structure 50C may be implemented as a rigid insert having a lower annular flange 52C that is supported on an annular ledge 54C formed at the base of the upper end member's hollow interior 16C. A tubular wall portion 56C of the support structure 50C is spaced from an interior side wall 28C of the hollow interior 16C. This provides an annular pocket in which the trigger 20C can slide. The top surface of the support structure 50C may be formed with an grating 58C (or other apertured surface) that allows the supercoolable fluid 18C to flow into contact with the clicker 22C. The clicker 22C is sequestered between the trigger 20C above and the support structure 50C below. It thus has a fixed or limited range of locations and orientations at the trigger end 6C of the roller 2C, which serves as a designated activation location. It will be seen in FIG. 7 that that the perimeter of the clicker 30C is not radially constrained as it is in hair roller 2 of FIGS. 1-4. Nor does the clicker 22C have a flat central portion. In order to prevent the clicker 22C from assuming an overcenter position, a stop member 60C formed on the top surface of the support structure 50C may be provided. The stop member 60C ensures that the clicker's convex surface will always protrude outwardly toward the trigger 20C.

Figure 8:
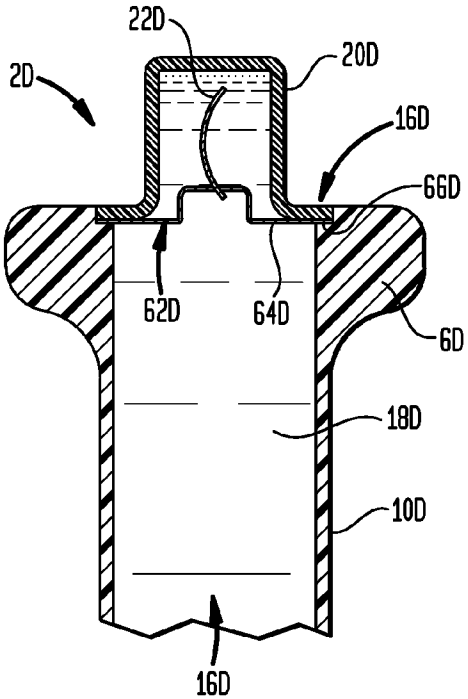
FIG. 8 is a partial cross-sectional centerline view showing another modification of the hair roller of FIG. 1.

Turning now to FIG. 8, another modified version 2D of the reusable self-heating hair roller 2 of FIGS. 1-4 is shown. Components of the hair roller 2D that correspond to components of the hair roller 2 are shown by the use of corresponding reference numbers appended with the letter "D." The hair roller 2D is similar to the hair roller 2 except that the trigger 20D is implemented as a squeezable rubber boot covering the hollow interior 16D of the upper end member 6D. The clicker 22D is in communication with the supercoolable fluid 18D within the cavity 16D, which flows upwardly into the interior of the trigger 20D. The clicker 22D is mounted on a support structure 62D within the casing. The support structure 62D may be implemented as a rigid insert having a lower annular flange 64D that is supported on an annular ledge 66D formed at the top of the upper end member's hollow interior 16D. The support structure 62D is apertured to allow the supercoolable fluid 18D to flow upwardly into communication with the clicker 22D. The clicker 22D is sequestered by virtue of being attached to the support structure 62D. In particular, one end of the clicker 22D is mounted to the support structure 62D to provide a cantilevered mounting arrangement that sequesters the clicker at a fixed location and at a relatively fixed orientation. The clicker 22D is thus positioned to be engaged by the trigger 20D at the trigger end 6D of the roller 2D, which serves as a designated activation location. Note that in FIG. 8, the clicker 22D is deformable to an over-center position and acts like a toggle switch that can be toggled back and forth between its two over-center positions by squeezing the trigger 20D.

Figure 9:
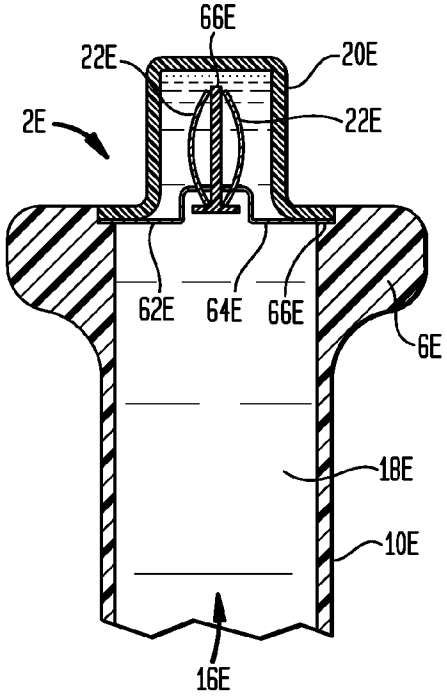
FIG. 9 is a partial cross-sectional centerline view showing another modification of the hair roller of FIG. 1.

FIG. 9 shows a modified version 2E of the reusable self-heating hair roller 2D of FIG. 8. Corresponding components are shown by corresponding reference numbers appended with the letter "E" instead of the letter "D." The principal difference between the hair rollers 2D and 2E is that the former uses a single clicker 22D while the latter uses two clickers 22E that extend upwardly in cantilevered fashion from a support structure 64E. In addition, a central stop member 66E is placed between the two clickers 22E to prevent over-center positioning.

Figure 10:
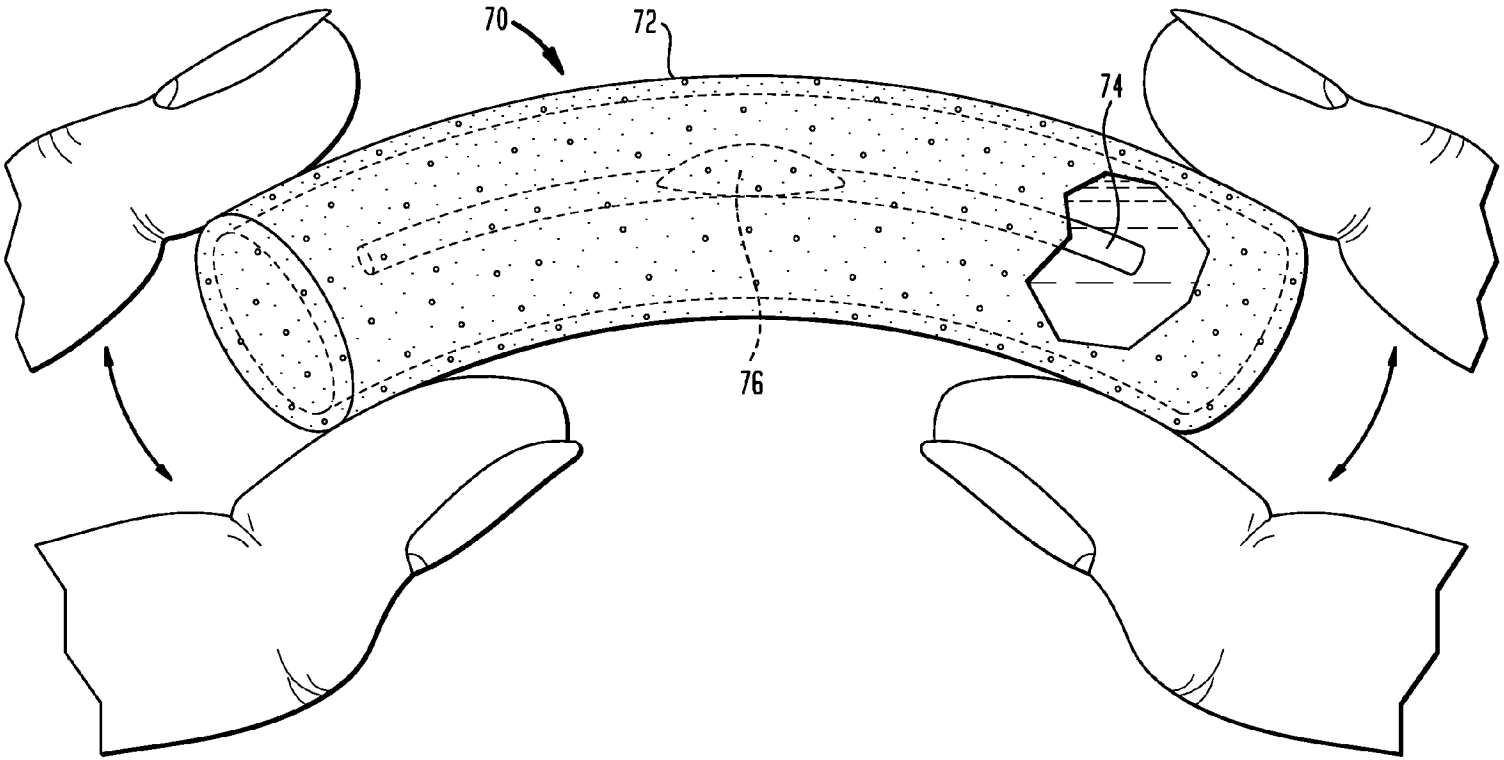
FIG. 10 is a side view showing another self-heating hair roller that may be constructed in accordance with the design principles set forth herein.

Turning now to FIG. 10, another example embodiment 70 of a reusable self-heating hair roller is shown. The hair roller 70 comprises a flexible or semi-rigid bladder 72 of generally cylindrical (or other shape) that provides an elongated fluid holding body. The bladder 72 can be formed from any suitable fluid impermeable material, such as a flexible or semi-rigid plastic or rubber film. A bendable wire 74 within the bladder provides an internal support structure for the bladder 72. The wire 72 may be either resilient or non-resilient. If the latter, the wire 72 will be capable of holding a shape so that the hair roller 70 can be bent into a custom shape. A dome-shaped clicker 76 may be mounted to the middle portion of the wire 74 to provide a nucleation initiator that is sequestered at a predetermined location in the roller. This sequestration restricts the clicker to a range of positions at a designated activation location that is centered around the midpoint of the longitudinal side wall of the bladder. The sequestration also restricts the clicker's rotational orientation relative to certain axes of rotation, but does allow free rotation of the clicker and the wire about the longitudinal axis of the wire (unless such rotation is otherwise restricted). Alternatively, the clicker (or other nucleation initiator) could be mounted to an inside wall of the bladder 72, or could be encased in a secondary bladder or other enclosure (not shown) that is fixedly positioned inside the bladder 72 that provides the fluid holding body. The clicker 76 can be activated by squeezing or bending the bladder 72 to apply an activation force to the clicker. If the bladder 72 is semi-rigid it may act as the act as the nucleation initiator when bent.

Turning now to FIGS. 11-14, another example embodiment 80 of a reusable self-heating hair roller is shown. The hair roller 80 comprises an elongated fluid holding body 82 that features a rigid or semi-rigid casing that comprises a pair of end members 84/86 and a wall portion 88 extending between the end members. The end members 84/86 may be generally disk-shaped and the wall portion 88 may be formed as an apertured cage of generally cylindrical (or other shape). The end members 84/86 and the wall portion 88 may be formed from any suitable material(s). Although the wall portion 88 is configured with parallel bars 90, other cage constructions could also be providing using any type of apertured structure. The fluid holding body 82 further comprises a flexible bladder 92 that is carried by the cage defined by the wall portion 88. The flexible bladder 92 holds a supercoolable fluid 94 (see FIG. 12). The flexible bladder 92 is disposed inside the parallel bars 90 that define the wall portion 88.

The flexible bladder 92 may have a hollow interior 96 in which is disposed an optional center post 98 made out of a suitable material (such as an insulator) to provide heat dissipation control, and/or to aid in structural integrity of the unit. The center post 98 (if present) may be used to control heat dissipation based on the choice of post material, i.e., heat insulator, heat conductor, etc. In all cases, the center post 98 (if present) gives rigidity to the hair roller 80 so that the wall portion 88 can be made to be less intrusive on the heat being transferred onto the hair. The wall portion 88 provides the scaffolding to maintain the desired shape of the hair roller 80, such as cylindrical or any other desired shape. This scaffolding also serves to limit any bending or agitation of the supercoolable fluid 94 so as to prevent or limit the possibility of an inadvertent activation.

Figure 11:
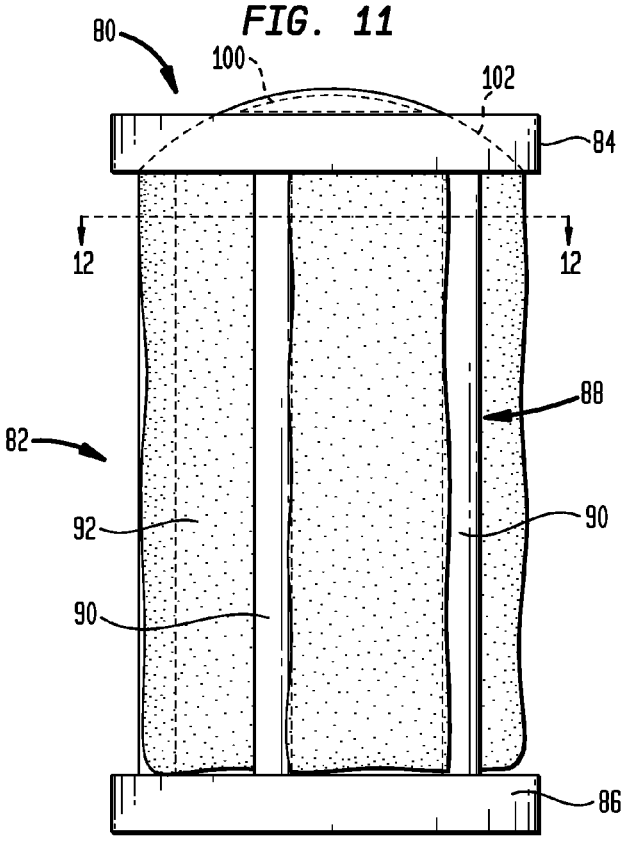
FIG. 11 is a side view showing another self-heating hair roller that may be constructed in accordance with the design principles set forth herein.
Figure 12:
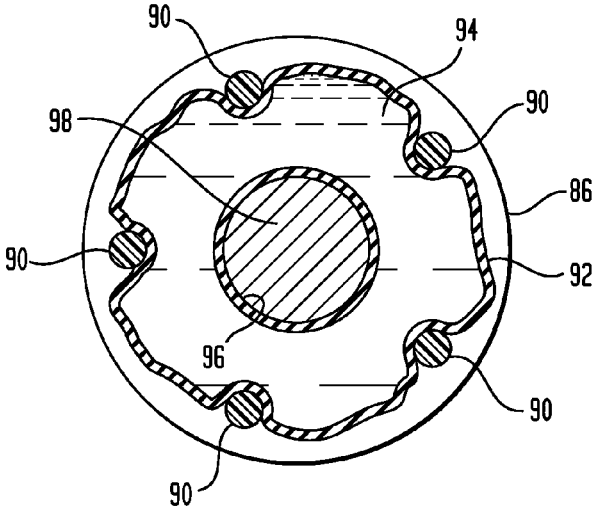
FIG. 12 is a cross-sectional view taken along line 12-12 in FIG. 11.
Figure 13:
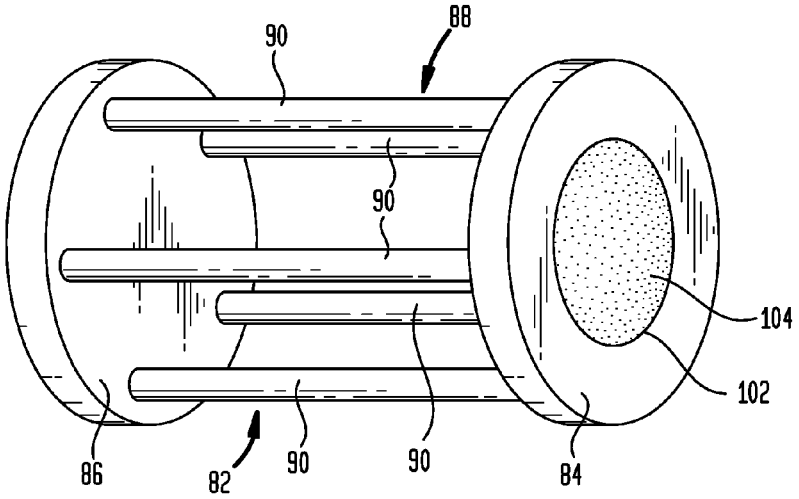
FIG. 13 is a perspective view showing a support structure of the hair roller of FIG. 11.
Figure 14:
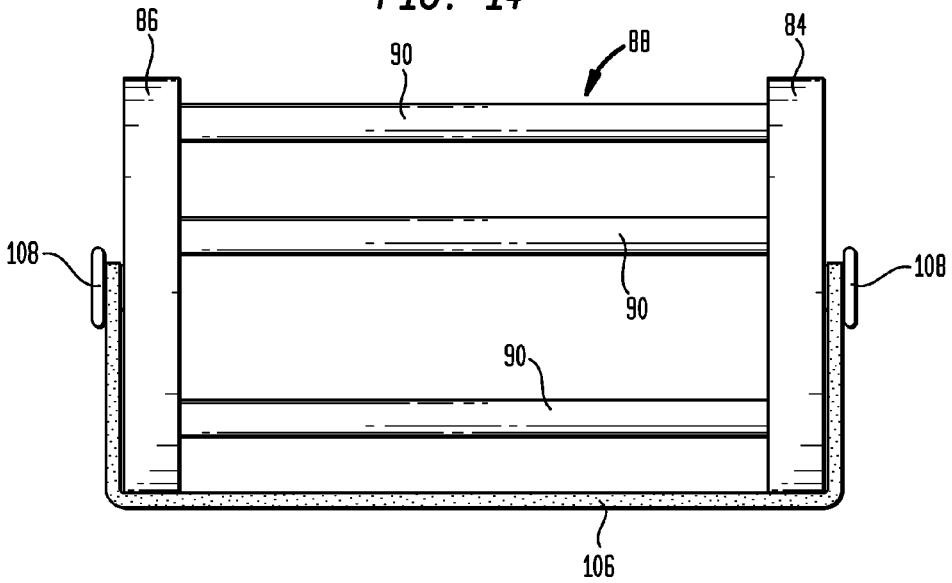
FIG. 14 is a side view showing a modification of the support structure of FIG. 13.

As can be seen in FIG. 11, a dome-shaped clicker 100 acting as a nucleation initiator can be mounted at the upper end of the flexible bladder 92, on the inside thereof, so that it is sequestered at a fixed or limited range of predetermined locations and orientations in the hair roller 80. The adjacent end member 84 may have an aperture 102 that allows the clicker end of the flexible bladder 92 to protrude so that the clicker 100 is accessible for activation, thereby providing a designated activation location on the hair roller 80. As shown in FIG. 13, the aperture may be covered with a flexible trigger mechanism 104 (such as a rubber button) that when depressed will activate the clicker 100. FIG. 14 illustrates the use of an optional clip 106 on the hair roller 80 for attaching the roller to the hair. The clip 106 may be formed as an elastic member and clip attachment posts 108 may be provided on the end members 84/86 for securing the clip.

Figure 15:
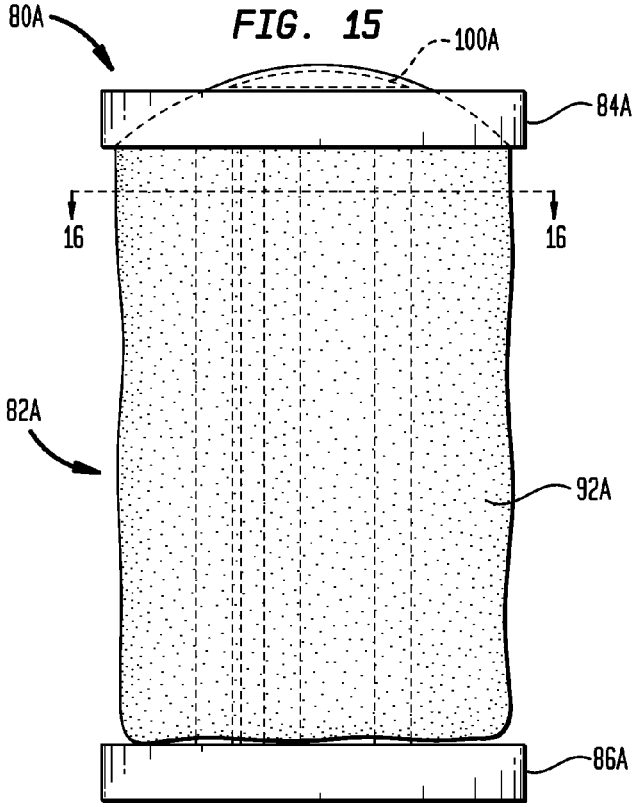
FIG. 15 is a side view showing another self-heating hair roller that may be constructed in accordance with the design principles set forth herein.
Figure 16:
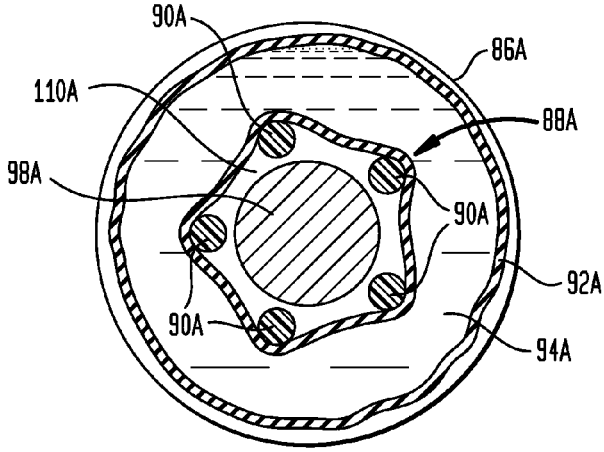
FIG. 16 is a cross-sectional view taken along line 16-16 in FIG. 15.

FIGS. 15-16 show a modified version 80A of the reusable self-heating hair roller 80 of FIGS. 11-14. Corresponding components are shown by corresponding reference numbers appended with the letter "A." The principal difference between the hair rollers 80 and 80A is that the flexible bladder 92A in the latter embodiment has a hollow interior 110A and is disposed outside the cage formed by the wall portion 88A. An optional heat dissipation controlling center post 98A may be disposed in the hollow interior 110A. For example, the center post 98A may act as a heat sink that traps heat generated by the supercoolable fluid, thereby preventing such heat from dispersing outwardly from the hair roller 2. The size of the flexible bladder 92A determines how much supercoolable fluid is in the hair roller 80A.

Figure 17:
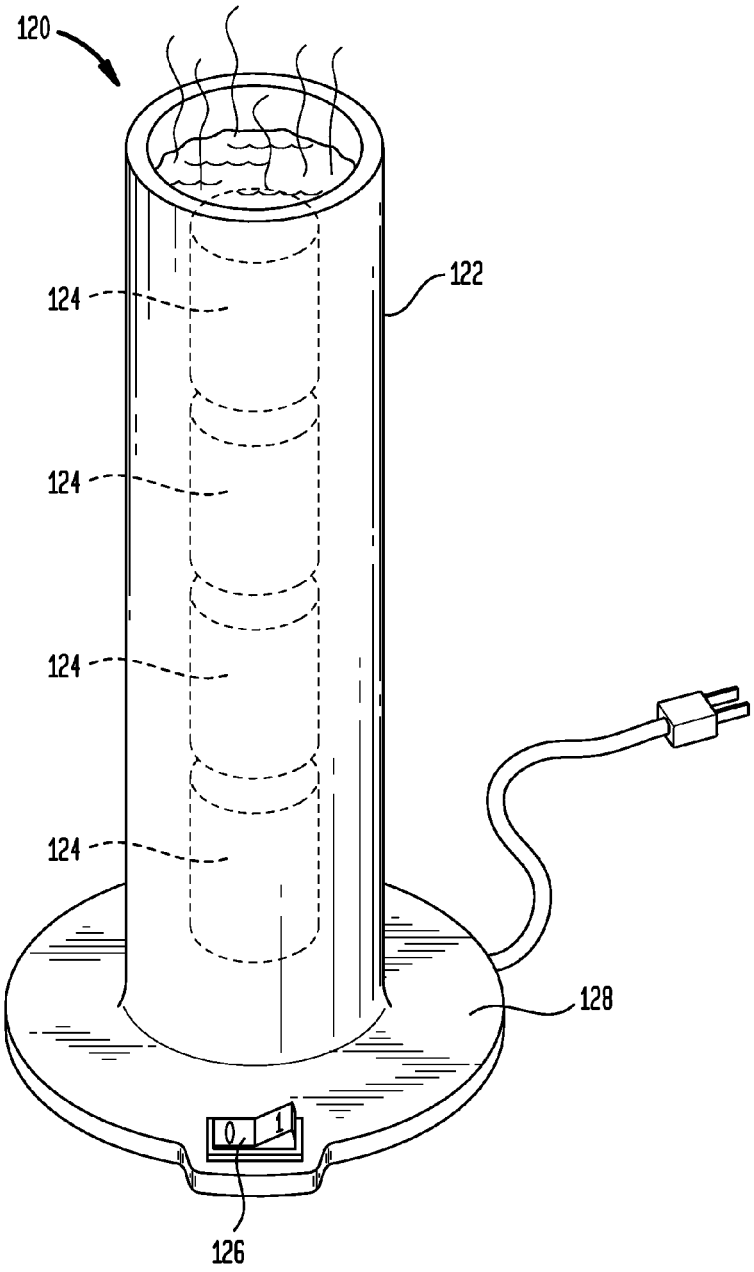
FIG. 17 is a perspective view showing an example embodiment of a recharging unit that may be used to recharge a hair roller constructed in accordance with the design principles set forth herein.

Turning now to FIG. 17, an auxiliary heating device 120 comprises a heating tower 122 that holds water, steam, air or some other heating medium, and is sized to receive one or more re-usable self-heating hair rollers 124. An electric heating element 126 may be provided at the base 128 of the heating device 120 to heat the medium in order to recharge the rollers 124.

It should be noted that all of the various nucleation initiators disclosed herein have been sequestered in terms of their location being restricted to a predetermined range of positions and their orientation by being restricted to a predetermined range of rotational angles. In terms of location, any restriction on the position of the nucleation initiator may be referred to a sequestration. In terms of rotational restriction, a nucleation initiator may be restricted so that is can only be rotated in any given direction by less than 90 degrees (e.g., approximately 89 degrees), which limits the rotation in that direction to one quadrant of a Cartesian coordinate system. The same restriction applies if the nucleation initiator is rotated in the opposite direction. Thus, the total range of rotation considering both rotational directions could be limited to less than 180 degrees (e.g., approximately 179 degrees). For a clicker type of nucleation initiator that is used in combination with a trigger, this type of sequestration would mean that the trigger should never rotate so that its edge is perfectly perpendicular with the face of the trigger. Doing so might prevent the trigger from activating the clicker. Additionally, the pressure of the trigger could result in the clicker rotating past 90 degrees, causing it to invert so that its concave side faces the trigger and it cannot be activated. On the other hand, if the clicker is sequestered to only rotate less than 90 degrees in any direction, pushing the trigger will tend to align the clicker back to its proper home position on the clicker support structure. Restricting the rotation of the clicker may be achieved by limiting the space between the clicker support structure and the trigger to a distance that is less than the diameter of the clicker. This also restricts the location range of the clicker. Other techniques for sequestering the location and orientation of a clicker or other nucleation initiator could no doubt also be used.

Accordingly, a reusable self-heating hair roller has been disclosed. Although example embodiments have been shown and described, it should be apparent that many variations and alternative embodiments could be implemented in accordance with the present disclosure. For example, an elongated fluid holding body could feature a segmented rigid or semi-rigid bladder with plural interconnected bladder chambers in fluid communication with each other. The nucleation initiator may be implemented in any suitable fashion. A clamp may be used to clasp the hair roller to the hair. It is understood, therefore, that the invention is not to be in any way limited except in accordance with the spirit of the appended claims and their equivalents.

What is claimed is:

1. A reusable self-heating hair roller comprising:

a fluid holding body having a shape compatible with curling or otherwise styling hair;

said body being elongated and having first and second closed end portions of substantially matching size, a wall portion extending between said end portions providing a hair wrapping region of said body, and a main cavity defined by said wall portion providing a fluid chamber that is closed at each end by said first and second end portions;

a supercoolable fluid sealed within said fluid chamber in fluid contact with said wall portion of said body, said supercoolable fluid being capable of being supercooled to room temperature while remaining in a liquid state, said supercoolable fluid being further capable of undergoing exothermic crystallization in response to a nucleation event in order to generate heat for hair curling, with said hair curling heat only having to transfer through said wall portion of said body and directly into hair wrapped around said hair wrapping region without passing through any other material; and a nucleation initiator in said body in contact with said supercoolable fluid.

2. The hair roller of claim 1, wherein said supercoolable fluid comprises a material selected from the group consisting of sodium acetate, either in pure form or diluted with another material.

3. The hair roller of claim 1, wherein said nucleation initiator is sequestered in such a way it is not capable of free floating throughout all of said supercoolable fluid in said body.

4. The hair roller of claim 1, wherein said nucleation initiator is sequestered in such a way it is not capable of free floating throughout all of said supercoolable fluid in said body and will be restricted to a location or orientation or a limited range of locations or orientations so that a user may access said nucleation initiator at a designated activation location on a wall or other surface portion of said fluid holding body without reliance on any visual cue or dependence on any specific up or down orientation of said hair roller.

5. The hair roller of claim 1, wherein said nucleation initiator is sequestered in said fluid holding body so that it is maintained at either a fixed location, a fixed orientation relative to one or more rotational axes, a fixed location and a fixed orientation relative to one or more rotational axes, a limited range of location, a limited range of orientation relative to one or more rotational axes, a limited range of location and a limited range of orientation relative to one or more rotational axes, a limited range of location and a fixed orientation relative to one or more rotational axes, or a fixed location and a limited range of orientation relative to one or more rotational axes.

6. The hair roller of claim 1, wherein said nucleation initiator is captured in a pocket in said fluid holding body.

7. The hair roller of claim 1, wherein said nucleation initiator is mounted to a structure within said fluid holding body.

8. The hair roller of claim 1, wherein said nucleation initiator is maintained at an end portion of said fluid holding body.

9. The hair roller of claim 1, wherein said nucleation initiator is maintained at a middle portion of said fluid holding body.

10. The hair roller of claim 1, wherein said nucleation initiator comprises a clicking device.

11. The hair roller of claim 1, further including a trigger on said fluid holding body that is arranged to allow activation of said nucleation initiator from outside said fluid holding body.

12. The hair roller of claim 11, wherein said trigger comprises a movable element or a deformable element that activates said nucleation initiator when said trigger is moved or deformed.

13. The hair roller of claim 1, wherein said fluid holding body is selected from the group consisting of flexible structures, rigid structures and semi-rigid structures.

14. The hair roller of claim 1, wherein said fluid holding body is generally cylindrical in shape.

15. The hair roller of claim 1, wherein said fluid holding body comprises a flexible or semi-rigid bladder that holds said supercoolable fluid.

16. The hair roller of claim 15, wherein said bladder is supported by a rigid or semi-rigid support structure.

17. The hair roller of claim 16, wherein said support structure is internal to said bladder.

18. The hair roller of claim 16, wherein said support structure comprises a bendable wire.

19. The hair roller of claim 18, wherein said bendable wire is a non-resilient wire that retains its shape when bent so that said fluid holding body may be configured in different shapes.

20. The hair roller of claim 18, wherein said nucleation initiator comprises a clicker mounted to said bendable wire.

21. The hair roller of claim 18, wherein said nucleation initiator is mounted to a middle portion of said bendable wire.

22. The hair roller of claim 18, wherein said nucleation initiator is accessible from outside said fluid holding body by squeezing said flexible bladder.

23. The hair roller of claim 16, wherein said support structure comprises an apertured cage.

24. The hair roller of claim 23, wherein said flexible bladder is disposed inside said cage.

25. The hair roller of claim 24, wherein said flexible bladder has a hollow interior in which is disposed a heat-regulating post.

26. The hair roller of claim 23, wherein said flexible bladder has a hollow interior and is disposed outside said cage.

27. The hair roller of claim 26, further including a heat-regulating post disposed in said hollow interior.

28. The hair roller of claim 1, wherein said fluid holding body comprises a rigid or semi-rigid casing.

29. The hair roller of claim 28, wherein said casing comprises said first and second end portions embodied as end members that are enlarged relative to said wall portion.

30. The hair roller of claim 29, further including a trigger mounted on one of said end members, and wherein said nucleation initiator is arranged to be activated by said trigger.

31. The hair roller of claim 30, wherein said nucleation initiator is mounted to said trigger or is positioned to be engaged by said trigger when said trigger is activated.

32. The hair roller of claim 30, wherein said trigger is configured such that activation thereof tends to decrease a fluid holding volume of said casing, and wherein said casing further includes a volume compensation component that compensates for said decrease in fluid holding volume caused by said trigger activation.

33. The hair roller of claim 1, wherein said fluid holding body comprises a volume control element whose size is selected to define a desired fluid holding volume of said fluid holding body in order to regulate a temperature output of said hair roller.

34. The hair roller of claim 1, further including a hair clasp for attaching said roller to a user's hair.

35. The hair roller of claim 1, in combination with a heating device that is operable to heat and re-energize said hair roller for subsequent reuse.

36. A method for using a hair roller to curl or style hair:

said roller comprising:

a fluid holding body having a shape compatible with curling or otherwise styling hair;

said body being elongated and having first and second closed end portions of substantially matching size, a wall portion extending between said end portions providing a hair wrapping region of said body, and a main cavity defined by said wall portion providing a fluid chamber that is closed at each end by said first and second end portions;

a supercoolable fluid sealed within said fluid chamber in fluid contact with said wall portion of said body, said supercoolable fluid being capable of being supercooled to room temperature while remaining in a liquid state, said supercoolable fluid being further capable of undergoing exothermic crystallization in response to a nucleation event in order to generate heat for hair curling, with said hair curling heat only having to transfer through said wall portion of said body and directly into hair wrapped around said hair wrapping region without passing through any other material; and a nucleation initiator in said body in contact with said supercoolable fluid;

said method comprising:

rolling said hair roller in a user's hair and activating said nucleation initiator to commence exothermic crystallization of said supercoolable fluid.

37. The method of claim 36 wherein said nucleation initiator is activated before rolling said hair roller in a user's hair.

38. The method of claim 36 wherein said nucleation initiator is activated after rolling said hair roller in a user's hair.

39. A reusable self-heating hair roller comprising:

a rigid or semi-rigid fluid holding body having a generally cylindrical shape compatible with curling or otherwise styling hair;

said body being elongated and of unitary construction, having first and second enlarged end members, a wall portion extending between said end members providing a hair wrapping region of said body, and a main cavity defined by said wall portion providing a fluid chamber;

said first end member having a hollow interior that provides an opening for accessing a first end of said main cavity;

said second end member having a solid configuration that includes an interior wall that closes a second end of said main cavity:

a supercoolable fluid disposed in said fluid chamber in fluid contact with said wall portion of said body, said supercoolable fluid being capable of being supercooled to room temperature while remaining in a liquid state, said supercoolable fluid being further capable of undergoing exothermic crystallization in response to a nucleation event in order to generate heat for hair curling, with said hair curling heat only having to transfer through said wall portion of said body and directly into hair wrapped around said hair wrapping region without passing through any other material;

a trigger mounted on said first end member and covering said hollow interior, said trigger being formed as a button-shaped member and acting as a seal that seals said main cavity at said first end member in order to retain said supercoolable fluid in said fluid chamber; and a nucleation initiator in said body in contact with said fluid and being sequestered in the vicinity of a designated activation location on said hair roller, said nucleation initiator being arranged to be actuated by said trigger.

* * * * *